US005362210A

United States Patent [19]

Richardson, Jr.

[11] Patent Number: 5,362,210

[45] Date of Patent: Nov. 8, 1994

[54] SCROLL COMPRESSOR UNLOADER VALVE

[75] Inventor: Hubert Richardson, Jr., Brooklyn, Mich.

[73] Assignee: Tecumseh Products Company, Tecumseh, Mich.

[21] Appl. No.: 23,583

[22] Filed: Feb. 26, 1993

[51] Int. Cl.[5] ..... F04B 49/00

[52] U.S. Cl. ..... 417/307; 417/310

[58] Field of Search ..... 417/310, 440, 307; 137/539

[56] References Cited

U.S. PATENT DOCUMENTS

| | | | |
|---|---|---|---|
| 4,347,915 | 9/1982 | Cooper | 137/539 |
| 4,431,388 | 2/1984 | Eber et al. | 418/55 |
| 4,560,330 | 12/1985 | Murayama | 418/55 |
| 4,904,164 | 2/1990 | Mabe et al. | 417/308 |
| 5,090,880 | 2/1992 | Mashimo | 418/15 |
| 5,169,294 | 12/1992 | Barito | 417/310 |

OTHER PUBLICATIONS

Scroll Compressor Design and Application Characteristics for Air Conditioning . . . , The Institute of Refrigeration, Nov. 1990.

*Primary Examiner*—Richard A. Bertsch
*Assistant Examiner*—Alfred Basichas
*Attorney, Agent, or Firm*—Baker & Daniels

[57] ABSTRACT

A hermetic scroll-type compressor including a housing at discharge pressure, fixed and orbiting scroll members, a frame member having a thrust surface adjacent the orbiting scroll member back surface, and a crankshaft coupled to the orbiting scroll member. A back surface of the orbiting scroll member is exposed to discharge pressure to cause the orbiting scroll member to axially comply with the fixed scroll member. An internal pressure relief valve is connected within the housing to the suction space between the scrolls to compensate for moments of high discharge pressure and relieve orbiting scroll member over loading on the fixed scroll member.

10 Claims, 2 Drawing Sheets

SCROLL COMPRESSOR UNLOADER VALVE

BACKGROUND OF THE INVENTION

The present invention relates generally to a hermetic scroll-type compressor including intermeshing fixed and orbiting scroll members and, more particularly, to such a compressor having an internal pressure relief valve to communicate discharge pressure into the intermeshed scrolls to thereby reduce overloading of the orbiting scroll member.

A typical scroll compressor comprises two facing scroll members, each having an involute wrap, wherein the respective wraps interfit to define a plurality of closed compression pockets. When one of the scroll members is orbited relative to the other, the pockets decrease in volume as they travel between a radially outer suction port and a radially inner discharge port, thereby conveying and compressing the refrigerant fluid.

It is generally believed that the scroll-type compressor could potentially offer quiet, efficient, and low-maintenance operation in a variety of refrigeration system applications. However, several design problems persist that have prevented the scroll compressor from achieving wide market acceptance and commercial success. For instance, during compressor operation, the pressure of compressed refrigerant at the interface between the scroll members tends to force the scroll members axially apart. Axial separation of the scroll members causes the closed pockets to leak at the interface between the wrap tips of one scroll member and the face surface of the opposite scroll member. Such leakage causes reduced compressor operating efficiency and, in extreme cases, can result in an inability of the compressor to operate.

In a compressor having a pressurized, or "high side", housing, discharge pressure has been used on the back side of the orbiting scroll member to create a compliance force to oppose the aforementioned separating force. This back pressure on the orbiting scroll, created with either pressurized refrigerant or oil at discharge pressure, causes the orbiting scroll to move axially toward and sealing with the fixed scroll to prevent refrigerant leaks.

At times, this loading of the orbiting scroll is too great, promoting rapid wear of the scroll wraps and faces with associated power losses. This overloading of the orbiting scroll is normally created by temporary high pressure conditions within the compressor caused by its associated refrigeration system. Excessive back pressure operating for too long of a time on the orbiting scroll member deforms the shape of the scrolls along with reducing the capacity of the compressor.

In some prior art compressors, having a low side or low pressure housing, a pressure relief valve is included for separating a discharge pressure cavity from the main housing cavity at suction pressure. In this type of compressor, the pressure relief valve opens to the whole suction cavity of the housing, not to the scroll set, thereby not altering the scroll set pressures instantly. The main operational feature of these prior art compressors is that they feed heated fluid at discharge pressure into the suction pressure housing to heat up and trip an overload sensor on the motor thereby halting compressor operation.

The present invention is directed to overcoming the aforementioned problems associated with scroll-type compressors, wherein it is desired to provide an internal pressure relief valve to prevent too great of an upward compliance force on the orbiting scroll member.

SUMMARY OF THE INVENTION

The present invention overcomes the disadvantages of the above-described prior art scroll-type compressors by providing an internal pressure relief valve communicating between the compressor housing at discharge pressure and the compressor scroll set at suction pressure, thereby permitting any over compliance of the orbiting scroll member to be reduced. Over compliance is caused by having too large of an upward force behind the orbiting scroll member. This causes the orbiting scroll member to be literally ground into the fixed scroll member thereby reducing the capacity of the compressor and increasing energy consumption.

Generally, the invention provides a scroll-type compressor including a fixed scroll member and an orbiting scroll member that are biased toward one another by an axial compliance mechanism. The axial compliance mechanism, in one form thereof, involves the application of discharge pressure to a portion of the back surface of the orbiting scroll member.

An internal pressure relief valve is located between interior sections of the compressor housing at discharge pressure and the scroll set at suction pressure. During an overpressure condition, the relief valve will open, dumping fluid at discharge pressure into the scroll set. This will substantially equalize the pressure on both sides of the orbiting scroll thereby at least partially unloading it with respect to the fixed scroll member.

An advantage of the scroll-type compressor of the present invention is the provision of an axial compliance mechanism that resists axial separation of the scroll members caused by both separating forces and overturning moments applied to the orbiting scroll member.

Another advantage of the scroll compressor of the present invention is the provision of a simple, reliable, inexpensive, and easily manufactured mechanism for relieving excess pressure in the compressor housing while at the same time effectively unloading the orbiting scroll member.

The scroll compressor of the present invention, in one form thereof, provides a hermetic scroll-type compressor including a housing at discharge pressure and having a suction pressure chamber at suction pressure. Within the housing are fixed and orbiting scroll members having respective wraps that are operably intermeshed to define compression pockets therebetween. A crankshaft is drivingly coupled to the orbiting scroll member at a location spaced axially from the intermeshed wraps, thereby causing the orbiting scroll member to orbit relative to the fixed scroll member. A portion of a back surface of the orbiting scroll member is exposed to either refrigerant or oil at discharge pressure, thereby exerting an axial compliance force on the orbiting scroll member toward the fixed scroll member. A relief valve mechanism is provided to relieve excess housing discharge pressure and communicate such pressure to the scroll set thereby at least partially unloading the orbiting scroll member.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENT

Figure 1:
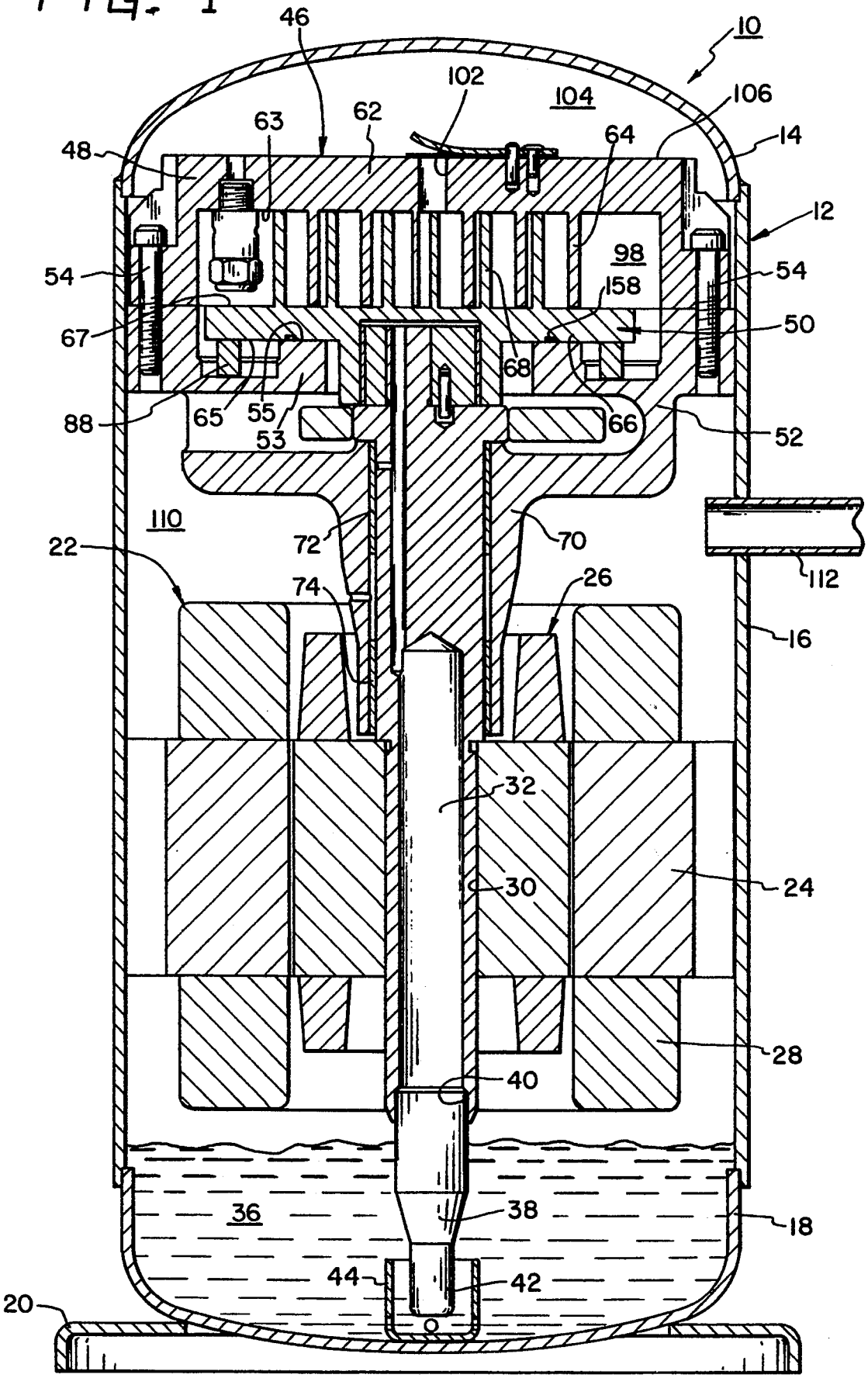
FIG. 1 is a longitudinal sectional view of a compressor of the type to which the present invention pertains.

In an exemplary embodiment of the invention as shown in the drawings, and in particular by referring to FIG. 1, a compressor 10 is shown having a housing generally designated at 12. This embodiment is only provided as an example and the invention is not limited thereto. The housing has a top cover portion 14, a central portion 16, and a bottom portion 18, wherein central portion 16 and bottom portion 18 may alternatively comprise a unitary shell member. The three housing portions are hermetically secured together as by welding or brazing. A mounting flange 20 is welded to bottom portion 18 for mounting the compressor in a vertically upright position.

Located within hermetically sealed housing 12 is an electric motor generally designated at 22, having a stator 24 and a rotor 26. Stator 24 is secured within central portion 16 of the housing by an interference fit such as by shrink fitting, and is provided with windings 28. Rotor 26 has a central aperture 30 provided therein into which is secured a crankshaft 32 by an interference fit. A terminal cluster (not shown) is provided in central portion 16 of housing 12 for connecting motor 22 to a source of electric power.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein. An oil inlet end 42 of pickup tube 38 extends downwardly into the open end of a cylindrical oil cup 44, which provides a quiet zone from which high quality, non-agitated oil is drawn.

Compressor 10 includes a scroll compressor mechanism 46 enclosed within housing 12. Compressor mechanism 46 generally comprises a fixed scroll member 48, an orbiting scroll member 50, and a main bearing frame member 52. As shown in FIG. 1, fixed scroll member 48 and frame member 52 are secured together by means of a plurality of mounting bolts 54. Precise alignment between fixed scroll member 48 and frame member 52 is accomplished by a pair of locating pins (not shown). Frame member 52 is mounted within central portion 16 of housing 12 by means of a plurality of circumferentially disposed mounting pins (not shown) of the type shown and described in assignee's U.S. Pat. No. 4,846,635, the disclosure of which is hereby incorporated herein by reference. The mounting pins facilitate mounting of frame member 52 such that there is an annular gap between stator 24 and rotor 26.

Fixed scroll member 48 comprises a generally flat face plate 62 having a face surface 63, and an involute fixed wrap 64 extending axially from surface 63. Likewise, orbiting scroll member 50 comprises a generally flat face plate 66 having a back surface 65, a top face surface 67, and an involute orbiting wrap 68 extending axially from surface 67. Fixed scroll member 48 and orbiting scroll member 50 are assembled together as a scroll set so that fixed wrap 64 and orbiting wrap 68 operatively interfit with each other. Furthermore, face surfaces 63, 67 and wraps 64,68 are manufactured or machined such that, during compressor operation when the fixed and orbiting scroll members are forced axially toward one another, the tips of wraps 64, 68 sealingly engage with respective opposite face surfaces 67, 63.

Main bearing frame member 52 includes an annular, radially inwardly projecting portion 53, including an axially facing stationary thrust surface 55 adjacent back surface 65 and in opposing relationship thereto. Back surface 65 and thrust surface 55 lie in substantially parallel planes and are axially spaced according to machining tolerances and the amount of permitted axial compliance movement of orbiting scroll member 50 toward fixed scroll member 48.

Main bearing frame member 52, as shown in FIG. 1 further comprises a downwardly extending bearing portion 70. Crankshaft 32 is rotatably journalled within bearings 72, 74 retained within bearing portion 70.

An eccentric crank mechanism 78 is situated on the top of crankshaft 32, as shown in FIG. 1. The crank mechanism and the oiling system of compressor 10 is shown and described in assignee's U.S. Pat. No. 5,131,828, the disclosure of which is hereby incorporated herein by reference.

Orbiting scroll member 50 is prevented from rotating about its own axis by means of a conventional Oldham ring assembly, comprising an Oldham ring 88 associated with orbiting scroll member 50 and frame member 52, respectively.

Compressor 10 includes an axial compliance mechanism characterized by a constantly applied force dependent upon the magnitude of the pressures in discharge pressure chamber 110 and suction pressure chamber 98.

With regard to the constantly applied force of the axial compliance mechanism, in one form of the invention, portions of back surface 65 are exposed to discharge and suction pressure, thereby providing a substantially constant force distribution acting upwardly upon orbiting scroll member 50 toward fixed scroll member 48. Consequently, moments about the central axis of orbiting scroll member 50 are minimized. More specifically, an annular seal mechanism 158, cooperating between back surface 65 and adjacent stationary thrust surface 55, sealingly separates between a radially inner portion and a radially outer portion of back surface 65, which are exposed to discharge pressure and suction pressure, respectively. Alternatingly, as is known in the art, either refrigerant fluid or lubricant fluid such as oil may be the medium to transfer discharge pressure to the back surface 65 of the orbiting scroll.

Figure 2:
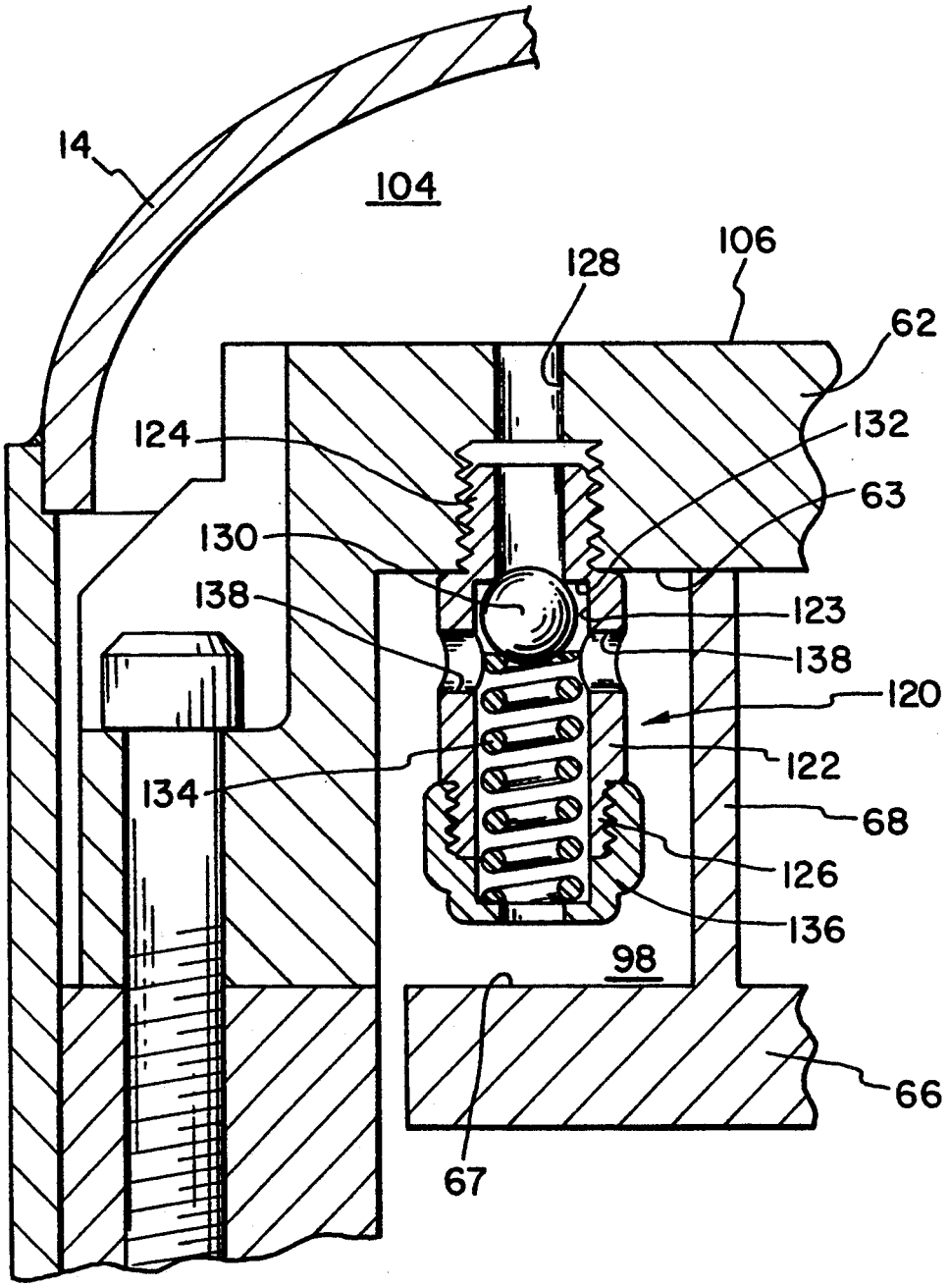
FIG. 2 is an enlarged fragmentary sectional view of the compressor of FIG. 1 showing the pressure relief valve of the present invention.

One form of the invention includes a pressure relief valve assembly 120 as shown in FIG. 2. Valve assembly 120 comprises a hollow housing 122 having top and bottom threaded portions 124 and 126 respectively. Top threaded portion 124 is threadedly connected to fixed scroll plate 62 in communication with discharge plenum 104 via discharge passageway 128.

A valve member such as a metallic ball valve 130, is urged into engagement with a seat 132 formed within a passageway 123 in housing 122. A biasing means such as spring 134 biases ball valve 130 into engagement with seat 132 to effectively seal discharge plenum chamber 104 and discharge passageway 128 from suction pressure chamber 98. Spring 134 is retained in place by a nut 136 threaded on bottom threaded portion 126. Housing 122 also includes ports 138 in communication with passageway 123.

In operation of the preferred embodiment, refrigerant fluid at suction pressure is introduced through a suction tube (not shown) into a suction pressure chamber 98 generally defined by fixed scroll member 48 and frame member 52. As orbiting scroll member 50 is caused to orbit, refrigerant fluid within suction pressure chamber 98 is compressed radially inwardly by moving closed pockets defined by fixed wrap 64 and orbiting wrap 68.

Refrigerant fluid at discharge pressure in the innermost pocket between the wraps is discharged upwardly through a discharge port 102 communicating through face plate 62 of fixed scroll member 48. Compressed refrigerant discharged through port 102 enters discharge plenum chamber 104 defined by top cover portion 14 and top surface 106 of fixed scroll member 48. Axially extending passages (not shown) allow the compressed refrigerant in discharge plenum chamber 104 to flow into housing chamber 110 defined within housing 12. As shown in FIG. 1, a discharge tube 112 extends through central portion 16 of housing 12 and is sealed thereat as by silver solder. Discharge tube 112 allows pressurized refrigerant within housing chamber 110 to be delivered to the refrigeration system (not shown) in which compressor 10 is incorporated.

During normal compressor operation, the relief valve assembly 120 will be closed with ball valve 130 biased against seat 132 by spring 134. The bias of spring 134 may be selected to different valves based upon the pressures expected within the compressor. Normally, the bias of spring 134 will be selected so that ball 130 will remain seated on seat 132 for all normal pressure conditions within discharge plenum 104.

On a condition of excessive pressure within discharge plenum 104, or more precisely, a particular pressure differential between discharge plenum 104 and suction pressure chamber 98, the pressure within discharge plenum 104 will communicate through discharge passageway 128 and cause ball 130 to move away from its seat 132. When this happens, discharge pressure within discharge passageway 128 is instantly permitted to move past ball 130 through passageway 132 and out into suction pressure chamber 98 within the scroll set (48, 50) via ports 138. Discharge pressure from discharge plenum 104 will fill suction pressure 98 thereby communicating discharge pressure onto the top surface 67 of orbiting scroll 50.

When discharge pressure is routed to the top surface 67 of orbiting scroll 50, orbiting scroll member 50 will then have substantially the same pressures on both its top and bottom surfaces. This eliminates the effect of a discharge pressure on the back surface 65 of orbiting scroll member 50. With the force of discharge pressure behind orbiting scroll member 50 effectively cancelled, orbiting scroll 50 is then not axially biased into engagement with fixed scroll member 48. This equalization of pressure on orbiting scroll member 50 reduces the friction and potential grinding effect of any excessive discharge pressure within compressor 10 on any excessive compliance force.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A scroll-type compressor for compressing refrigerant fluid, comprising:

a hermetically sealed housing including therein a discharge chamber containing refrigerant at discharge pressure and a suction chamber containing refrigerant at a suction pressure, said housing pressurized to discharge pressure;

a scroll set including a fixed scroll member in said housing having an involute fixed wrap element and an orbiting scroll member in said housing including a plate portion having a face surface and a back surface, said face surface having an involute orbiting wrap element thereon intermeshed with said fixed wrap element, said orbiting scroll wrap located within said suction pressure chamber;

fluid at substantially discharge pressure acting against the back surface of said orbiting scroll;

drive means for causing said orbiting scroll member to orbit relative to said fixed scroll member; and a pressure valve connecting from said discharge chamber directly into said scroll set, said pressure valve automatically conducting discharge pressure into said scroll set in response to a high pressure condition, whereby said orbiting scroll member is at least partially unloaded.

2. The compressor of claim 1 in which said internal pressure valve immediately partially equalizes the pressure applied to said orbiting scroll member.

3. The compressor of claim 1 in which said pressure valve includes a housing having a passageway therethrough communicating discharge pressure from said discharge chamber to said scroll set, said passageway including a valve seat, a valve member seatable in said valve seat, and a yieldable biasing means to seal said valve member in said valve seat, said valve unseated from said valve seat when said discharge pressure overcomes the force of said biasing means.

4. A scroll-type compressor for compressing refrigerant fluid, comprising:

a hermetically sealed housing including therein a discharge chamber containing refrigerant at a discharge pressure and a suction chamber containing refrigerant at suction pressure;

a fixed scroll member in said housing including an involute wrap element;

an orbiting scroll member including a plate portion having a face surface and a back surface, said face surface having an involute orbiting wrap element thereon intermeshed with said fixed wrap element, said back surface including portions exposed to discharge pressure and suction pressure;

a thrust surface adjacent said orbiting scroll member back surface;

seal means between said orbiting scroll member and said thrust surface for sealingly separating between respective portions of said plate portion back surface exposed to discharge pressure and suction pressure;

drive means for causing said orbiting scroll member to orbit relative to said fixed scroll member; and a pressure relief valve means for automatically conducting discharge pressure directly to said orbiting scroll member in response to an overpressure condition whereby said orbiting scroll member is at least partially unloaded.

5. The compressor of claim 4 in which said pressure valve includes a housing having a passageway therethrough communicating discharge pressure from said discharge chamber to between said fixed scroll member and said orbiting scroll member, said passageway including a valve seat, a valve member seatable in said valve seat, and a yieldable biasing means to seal said valve member in said valve seat, said valve member unseated from said valve seat when said discharge pressure overcomes the force of said biasing means.

6. The compressor of claim 4 in which said pressure relief valve substantially unloads said orbiting scroll member.

7. The compressor of claim 4 including:

axial compliance means for exerting refrigerant fluid pressure on said orbiting scroll plate back surface to axially press said scroll members together.

8. A scroll-type compressor for compressing refrigerant fluid comprising:

a hermetically sealed housing including therein a discharge pressure chamber containing refrigerant at a discharge pressure and a suction chamber containing refrigerant at a suction pressure;

a fixed scroll member in said housing including an involute wrap element;

an orbiting scroll member in said housing including a plate portion having a face surface and a back surface, said face surface having an involute orbiting wrap element thereon intermeshed with said fixed wrap element;

a fluid at discharge pressure contacting a portion of said orbiting scroll member back surface and forcing together said orbiting and fixed scroll members; and an internal pressure relief valve automatically conducting fluid at discharge pressure directly from said discharge pressure chamber to between said fixed scroll member and said orbiting scroll member in response to an overpressure condition.

9. The compressor of claim 8 in which said pressure valve includes a housing having a passageway therethrough communicating discharge pressure from said discharge chamber between said fixed scroll member and said orbiting scroll member, said passageway including a valve seat, a valve member seatable in said valve seat, and a yieldable biasing means to seal said valve member in said valve seat, said valve member unseated from said valve seat when said discharge pressure overcomes the force of said biasing means.

10. The compressor of claim 4 in which said pressure relief valve substantially unloads said orbiting scroll member.

* * * * *